US006381931B2

(12) United States Patent
Balkenhol

(10) Patent No.: US 6,381,931 B2
(45) Date of Patent: May 7, 2002

(54) STRAP-ATTACHED SPUR

(75) Inventor: Klaus Balkenhol, Rosendahl (DE)

(73) Assignee: Herm. Sprenger GmbH & Co. KG (DE)

( * ) Notice: Subject to any disclaimer, the term of this patent is extended or adjusted under 35 U.S.C. 154(b) by 0 days.

(21) Appl. No.: 09/753,010

(22) Filed: Jan. 2, 2001

(51) Int. Cl.[7] ..... A43C 17/00
(52) U.S. Cl. ..... 54/83.1
(58) Field of Search ..... 54/83.1, 83.2; D30/157; 36/114, 136

(56) References Cited

U.S. PATENT DOCUMENTS 1,057,620 A * 4/1913 Copley ..... 54/83.2
1,182,344 A * 5/1916 Buermann ..... 54/83.2
1,882,059 A * 10/1932 Boos ..... 54/83.2
D289,809 S * 5/1987 Pela ..... 54/83.1
4,910,883 A * 3/1990 Zock, Jr. ..... 36/114
5,450,712 A * 9/1995 Van Scoyk ..... 54/83.1
6,192,663 B1 * 2/2001 Gatlin et al. ..... 54/83.1

* cited by examiner

*Primary Examiner*—Charles T. Jordan
*Assistant Examiner*—Elizabeth Shaw
(74) *Attorney, Agent, or Firm*—Akerman Senterfitt

(57) ABSTRACT

The invention relates to a strap-attached spur which is configured substantially U-shaped and has two lateral bars. Two spur strap eyelets are provided for in each free end of each bar and receive a spur strap of the strap attachment. The two spur strap eyelets of either end are not parallel but form an acute angle between each other.

13 Claims, 1 Drawing Sheet

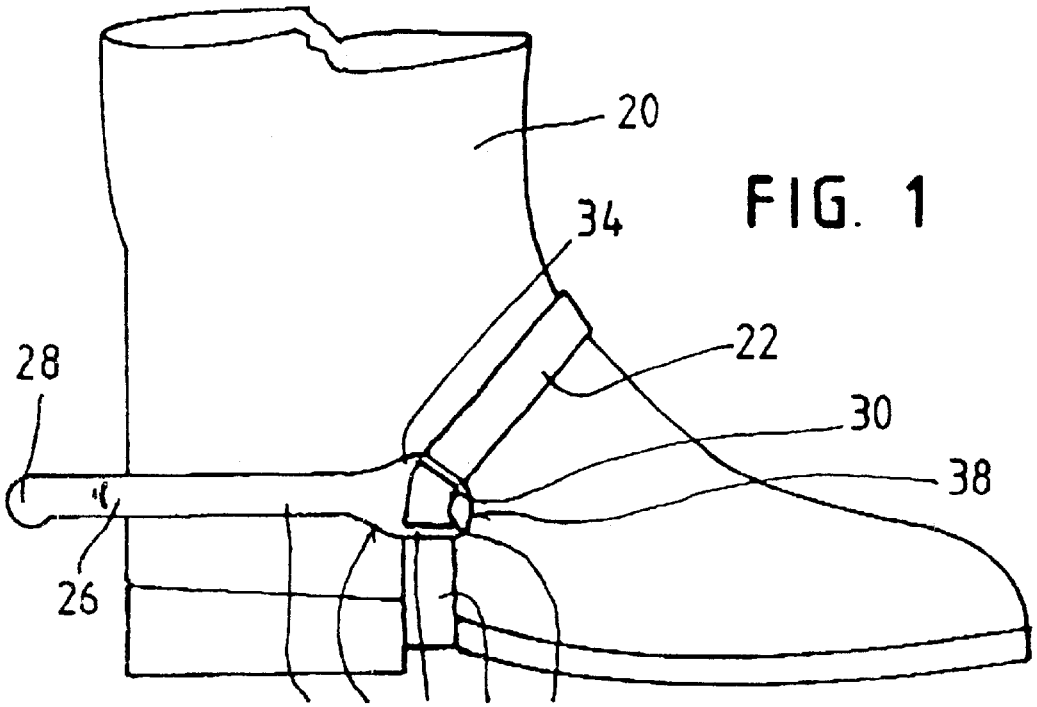
FIG. 1
FIG. 2
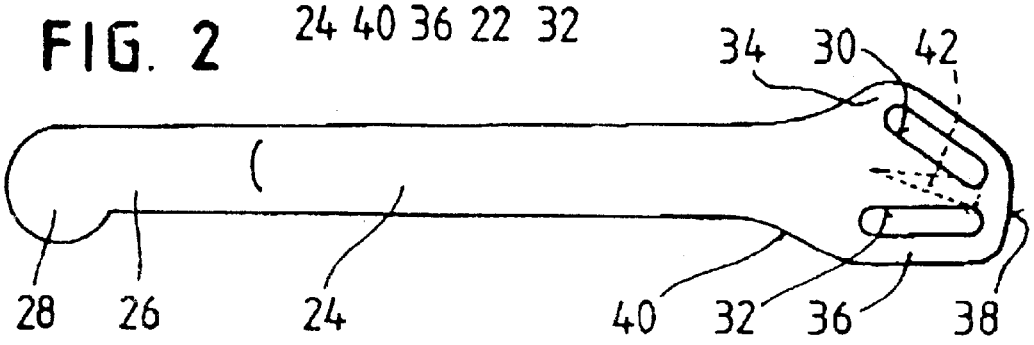
FIG. 3
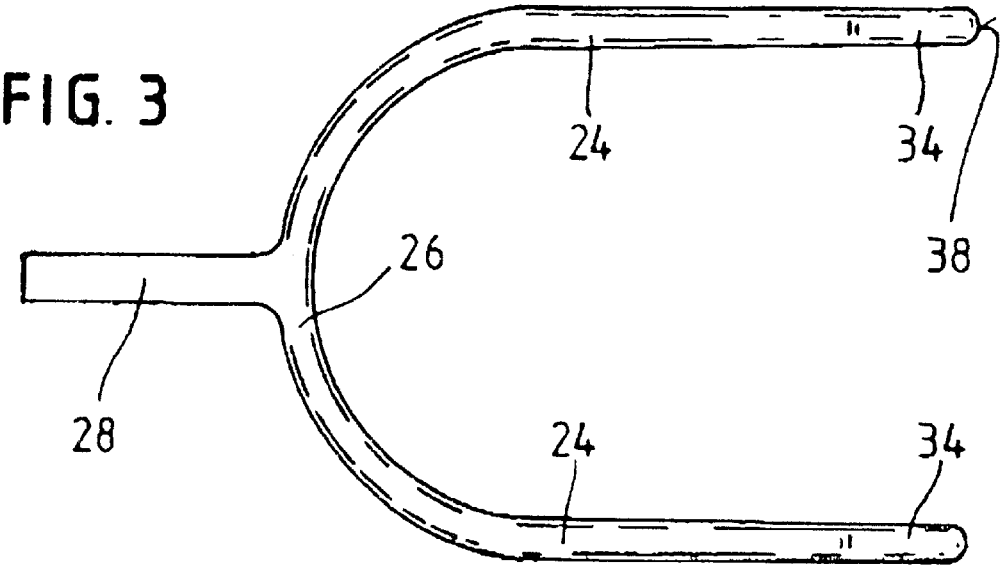

STRAP-ATTACHED SPUR

BACKGROUND OF THE INVENTION

The invention relates to a strap-attached spur which is configured substantially U-shaped and has two lateral bars, two spur strap eyelets being provided for in each free end of each bar, said spur strap eyelets receiving a spur strap of the strap attachment. Spurs of this type are used in horseback riding for example.

On the prior art spurs, the spur strap eyelets are parallel. This is irrespective of their concrete shape. The eyelets may indeed be given the shape of a long hole, i.e., with rounded end areas, the shape of oblong rectangles or the shape of a segment of a circle. According to the state of the art, they are always arranged in twofold symmetry.

This well known arrangement has some disadvantages however. In order to be able to fasten a spur to a rider's boot, one spur strap must be guided from the upper spur strap eyelets of each bar about the instep. Furthermore, the spur strap must be led from the lower spur strap eyelets of the spur straps and pass underneath the shoe and in front of the heel. The two directions of the spur strap however are not paralleled, they are rather positioned at an angle typically ranging between 30 and 60°. As a result, the spur strap warps on one side. It arches outward and only abuts with one longitudinal rim while gaping at the other longitudinal rim.

Usually, the two spur strap eyelets of each lateral bar are parallel to the direction of said lateral bar. In this event, although the spur strap is guided downward in a clean and correct manner, it does not fully rest on the boot toward the top, about the instep. Accordingly, it is not guided about the instep in the right position for use. As a result, it tends to slip. A correct fixation is not achieved. The inaccurate guiding is visible and disturbing as such. Due to the parallel position of the two spur strap eyelets, the spur strap is unilaterally distorted by way of the front edge of the eyelet of the spur strap eyelet facing the free end of the lateral bar, the spur strap being distorted on the side facing the boot and applying more force to this area, thus exerting a stronger local pressure onto the bones of the ankle. All this is unfavorable.

SUMMARY OF THE INVENTION

It is the object of the invention to avoid these drawbacks of the prior art spur mentioned above and to propose a spur which permits to guide in a clean, fully fitting manner the upper area of the spur strap as well as the lower area of the spur strap.

Starting from the spur of the type mentioned above, the solution of this object is to have the two spur strap eyelets of each end area of the lateral bars not paralleled, but relatively angled.

As a result and according to the invention, the two spur strap eyelets of each lateral bar are oriented in such a manner that they are substantially positioned at right angles to the course of that area of the spur strap that originates in them. As a result thereof, the strap rests with its whole surface on the boot (or on any other riding shoe). Thus, slipping is made more difficult. The strap is prevented from resting only at one side, thus strongly weighing on the bones of the foot. The overall aesthetic appeal is considerably enhanced. Tension is uniformly allotted to the two edge areas of the spur strap and no longer to only one side as it is the case with the spurs of the prior art. As a result, the spur strap is easier to put on, it slides more readily through the spur strap eyelets.

According to the invention, the spur strap eyelets of each lateral bar are relatively disposed in a V-shaped arrangement. The vertex of the V points toward the free end of each lateral bar. In other words, the distance between the two spur strap eyelets increases when looking from the free end toward the base of the lateral bar.

The upper spur strap eyelet is inclined to the direction of the corresponding lateral bar at an angle of preferably between 5° and 120°, preferably between 5° and 80°, in particular at an angle from 20° to 60°. In so doing, the desired, optimal course is achieved, said course being practically at right angles to the longitudinal course of the spur strap.

Arching now no longer occurs outside the area of the two spur strap eyelets, but rather between them. Here though, it hardly irritates, and may additionally be absorbed by an appropriate guiding which reduces the upward slope of the arch and forms it into a suitable shape. To this effect, a guide means for the spur strap is provided in that area in which the two spur strap eyelets of each lateral bar are farthest apart, said guide means allowing the spur strap to describe an inward or an outward curve and tapering off toward the point at which the two spur strap eyelets are closely adjacent.

In a preferred embodiment the two spur strap eyelets are long holes, that is, they are limited by two semicircular curves and by two straight lines. They may be any other shape however, and assume for example the shape of oblong rectangles, ovals or the like.

In a particularly preferred embodiment, the lateral bars are each provided with a curve in the end area of the upper instep strap eyelet. This curve substantially conforms to the shape of this upper instep strap eyelet. The lateral bars are thus given a particularly characteristic shape with aesthetic appeal which positively distinguishes them from the hitherto customary shapes. Furthermore room is made which is needed for the configuration of the upper instep strap eyelet.

BRIEF DESCRIPTION OF THE DRAWINGS

Further advantages and characteristics of the invention will become apparent in the remaining claims and in the following description of an embodiment which is only an example and is not limiting the scope of the invention, said embodiment being explained in more detail with reference to the drawing.

FIG. 1: is a lateral view of a (partially illustrated) riding boot provided with a strapped spur in accordance with the invention, FIG. 2: is a lateral view of the spur alone, without its strap, and FIG. 3: is a top view of the spur of FIG. 2.

DETAILED DESCRIPTION OF THE PREFERRED EMBODIMENTS

A spur strapped by a spur strap 22 is attached to a riding boot 20 which is customary in trade and whose upper leg area is not shown in FIG. 1. The spur strap is made of one piece and has a length of about 45 cm. As is conventional in this art, it has a fastener which cannot be seen in FIG. 1 since it is located behind the boot and is typically made of braided synthetic threads or consists of a leather thong.

The spur is substantially U-shaped, it has two lateral bars 24 which are essentially built according to the same design principle. They are integral with a base part 26 from which a spur 28 in turn protrudes in opposite direction from the two lateral bars 24.

At the free end of each lateral bar 24 there is provided a head area in which two spur strap eyelets are located, viz., an upper spur strap eyelet 30 and a lower spur strap eyelet 32. Both eyelets are long holes which are limited by parallel straight lines and approximately semicircular end areas. In clear dimensions they are approximately 17 mm long and about 4 mm wide in crosswise direction. These two spur strap eyelets 30, 32 are not paralleled, they are rather positioned at an angle which is of approximately 35° in the embodiment shown, but which can vary considerably about this value. The two spur strap eyelets 30, 32 are thereby arranged in such a way that they are located on the legs of a horizontal V whose vertex is located in the neighborhood of the free end of each lateral bar 24 and which accordingly widens toward the spur 28.

As shown in the FIGS. 1 and 2, the lower spur strap eyelet 32 runs parallel to the longitudinal direction of the corresponding lateral bar 24. Under normal wearing conditions and as also shown in FIG. 1, said spur strap eyelet 32 accordingly runs parallel to a spur base supporting the boot. As more specifically shown in FIG. 2, the head area of each lateral bar is thicker than the remaining part of said lateral bar. An upward curve 34 is provided which conforms to the contours of the upper spur strap eyelet 30, a lower extension 36 is furthermore provided which in turn also essentially conforms to the contours of the lower spur strap eyelet 32. Both spur strap eyelets 30, 32 terminate, on the front part for example, on a line which crosses the longitudinal direction of the lateral bars 24. The foremost, free edge 38 is designed accordingly and forms a right angle with respect to the longitudinal direction of the lateral bars 24.

The head area of the two lateral bars 24 assumes a very characteristic shape on account of the curve 34 and the lower extension 36, thus differing noticeably from the state of the art spurs.

The upper limiting edge of the lower spur strap eyelet 32 is substantially an extension of the lower edge of the corresponding lateral bar 24. The upper edge of the lateral bar 24 is extending undisturbedly toward the front and intersects the upper spur strap eyelet 30 approximately in its center. The transitions from the undisturbed straight lateral bar 24 to the head area are adapted in their design so that an essentially roof-shaped tip is achieved in the upper part, and a slope 40 is obtained in the lower, said slope starting earlier however.

In order to compensate for an arching of the spur strap 22 which rests on the outer side of the spur in the area between the two spur strap eyelets 30, 32 (see FIG. 1), the spur strap 22 is, in an improved embodiment, guided more strongly outward or inward at those places where material is abounding, that is in that area, where the two spur strap eyelets 30, 32 are very close. Here, a guide means sketched in dashed lines is provided in the form of an arch 42 that linearly tapers off toward zero in the direction of the area in which the two spur strap eyelets 30, 32 are farthest apart. When using braided spur straps 22, such an arch is less important than it is with leather thongs. The two spur strap eyelets 30, 32 can unite in their area facing the front end, which means that they may be joined together. In this case, a guide means may be designed in having the transition piece, which is located between the two spur strap eyelets 30, 32 and which terminates in a free end in this event, bending outward, said bend tapering off toward zero as well at the other lateral edge of the spur strap.

What is claimed is:

1. A spur with a strap attachment, which strap attachment is attached to said spur, said spur having a substantially U-shaped form and having two lateral bars, each lateral bar having a free end, two spur strap eyelets being provided for in each free end of each lateral bar, said spur strap eyelets receiving a strap of the strap attachment, the two spur strap eyelets of each end area are not paralleled but are inclined to one another at an angle, wherein a guide means for the strap is provided, said guide means being arranged in an area between the two spur strap eyelets of each lateral bar, said guide means allowing said strap to describe a curve and said guide means tapering off toward a point at which the two spur strap eyelets of each lateral bar are farthest apart.

2. Spur according to claim 1, wherein one of the two spur strap eyelets of each lateral bar is an upper spur strap eyelet, said upper spur strap eyelet being inclined to a direction of the corresponding lateral bar at an angle of between 5° and 120° preferably between 5° and 80°, in particular at an angle from 20° to 60°.

3. Spur according to claim 2, wherein a longitudinal center line passing through the upper spur strap eyelet intersects a longitudinal center line of the corresponding later bar outside the upper spur strap eyelet on its side facing the free end.

4. Spur according to claim 2, wherein the angle is between 5° and 80°.

5. Spur according to claim 2, wherein the angle is between 20° and 60°.

6. Spur according to claim 1, wherein one of the two spur strap eyelets of each lateral bar is an upper spur strap eyelet, said upper spur strap eyelet having an upper area, and wherein a curve pointing upward when in use is provided about the upper area of the upper spur strap eyelet.

7. Spur according to claim 1, wherein one of the two spur strap eyelets of each lateral bar is a lower spur strap eyelet, said lower spur strap eyelet being essentially parallel to the corresponding lateral bar of the spur.

8. Spur according to claim 1, wherein the two spur strap eyelets of each lateral bar are essentially built according to the same design principle and are executed as long holes.

9. Spur according to claim 1, wherein one of the two spur strap eyelets of each lateral bar is a lower spur strap eyelet, said lower spur strap eyelet being inclined to a direction of the corresponding lateral bar at an angle of between 5° and 120°.

10. Spur according to claim 9, wherein the angle is between 5° and 80°.

11. Spur according to claim 9, wherein the angle is between 20° and 60°.

12. Spur according to claim 1, wherein said curve is an inward curve.

13. Spur according to claim 1, wherein said curve is an outward curve.

* * * * *

UNITED STATES PATENT AND TRADEMARK OFFICE

CERTIFICATE OF CORRECTION

PATENT NO. : 6,381,931 B2
DATED : May 7, 2002
INVENTOR(S) : Balkenhol

It is certified that error appears in the above-identified patent and that said Letters Patent is hereby corrected as shown below:

Title page,
Item [22], change "[22] Filed: Jan.2, 2002" to -- [22] PCT Filed: Feb. 18, 1999 --
After item [22], insert
-- [86] PCT No. PCT/DE99/00446
§371(1), (2), (4) Date: Mar. 26, 2001

[87] PCT Pub. No.: WO 00/01268
PCT Pub. Date: Jan. 13, 2000

[30] Foreign Application Priority Data

July 06, 1998 (DE) Germany ..... 298 11 838
July 03, 1998 (DE) Germany ..... 298 11 754 --

Signed and Sealed this

Twenty-second Day of July, 2003

JAMES E. ROGAN
*Director of the United States Patent and Trademark Office*